US007886473B2

(12) United States Patent
Rothärmel

(10) Patent No.: US 7,886,473 B2
(45) Date of Patent: Feb. 15, 2011

(54) STOCKS AND CASING FOR A RIFLE

(75) Inventor: Jürgen Rothärmel, Altusried (DE)

(73) Assignee: Blaser Finanzholding GmbH, Isny Im Allgau (DE)

( * ) Notice: Subject to any disclaimer, the term of this patent is extended or adjusted under 35 U.S.C. 154(b) by 343 days.

(21) Appl. No.: 12/048,290

(22) Filed: Mar. 14, 2008

(65) Prior Publication Data

US 2010/0275490 A1 Nov. 4, 2010

(30) Foreign Application Priority Data

Mar. 26, 2007 (DE) ..... 10 2007 014 899

(51) Int. Cl.
*F41C 23/00* (2006.01)
*F41C 23/16* (2006.01)

(52) U.S. Cl. ..... 42/75.03

(58) Field of Classification Search ..... 42/71.01, 42/72, 73, 75.03; D22/108
See application file for complete search history.

(56) References Cited

U.S. PATENT DOCUMENTS 371,886 A * 10/1887 Hibbard ..... 42/71.01
1,025,529 A * 5/1912 Johnson ..... 42/71.01
1,063,061 A * 5/1913 Pickering ..... 42/73
2,288,901 A * 7/1942 Green ..... 42/75.03
2,627,688 A 2/1953 Cooper
3,267,923 A * 8/1966 Ronci ..... 124/84
3,683,535 A * 8/1972 Lewis ..... 42/71.02
3,739,515 A * 6/1973 Koon, Jr. ..... 42/75.03
4,290,220 A 9/1981 Ruger
4,944,109 A * 7/1990 Zedrosser ..... 42/71.01
5,159,136 A * 10/1992 Marsh ..... 42/71.01
D443,912 S * 6/2001 Henderson ..... D22/108
6,662,485 B2 * 12/2003 Kay ..... 42/75.03
6,981,344 B2 * 1/2006 Cahill et al. ..... 42/71.01

FOREIGN PATENT DOCUMENTS

DE 103 23 338 A1 12/2004

* cited by examiner

*Primary Examiner*—Bret Hayes
(74) *Attorney, Agent, or Firm*—Martin Fleit; Paul D. Bianco; Fleit Gibbons Gutman Bongini & Bianco PL

(57) ABSTRACT

The invention relates to a stock (2; 3) of a repeating rifle with a connection region (21; 22) for connecting the stock (2; 3) to a system casing (1), with the connection region (21; 22) containing curved end connection surfaces (24; 34) for contacting correspondingly curved contact surfaces (9; 10) of the system casing (1) and the connection region (21; 22) having a recess (23; 33) tapering inward on the bottom side and a lower contact surface (28; 38) for contacting an upper support surface (16; 20) of the system casing (1). The invention further relates to a system casing for such a stock and a repeating rifle with such a system casing and stock.

17 Claims, 5 Drawing Sheets

Fig. 7
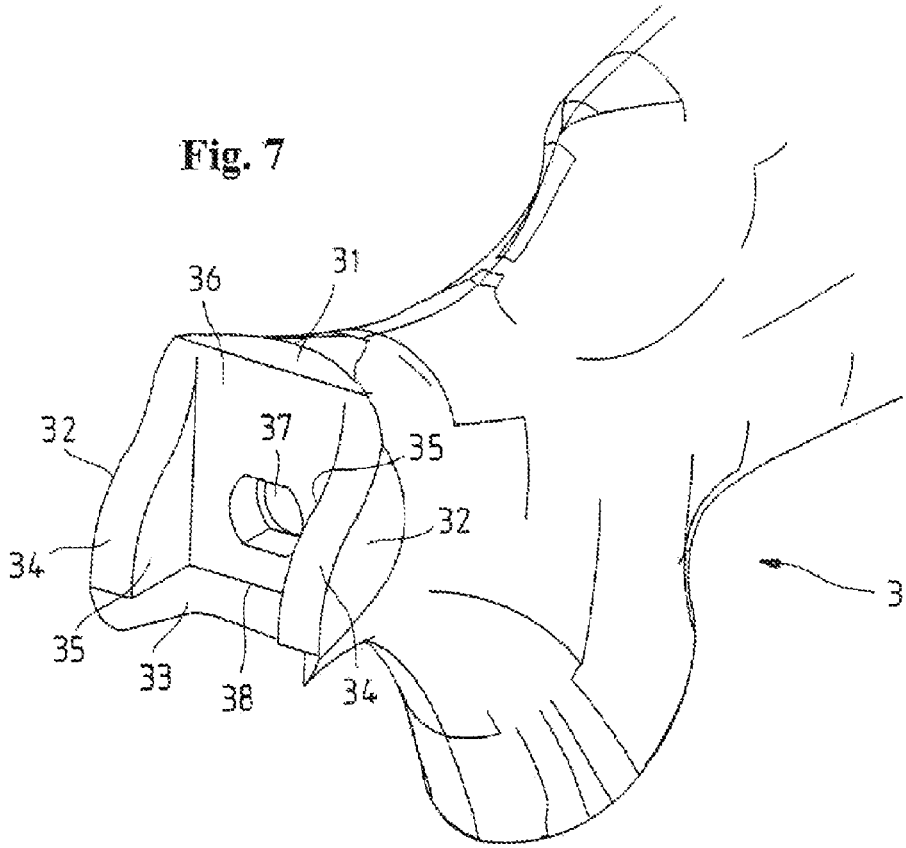
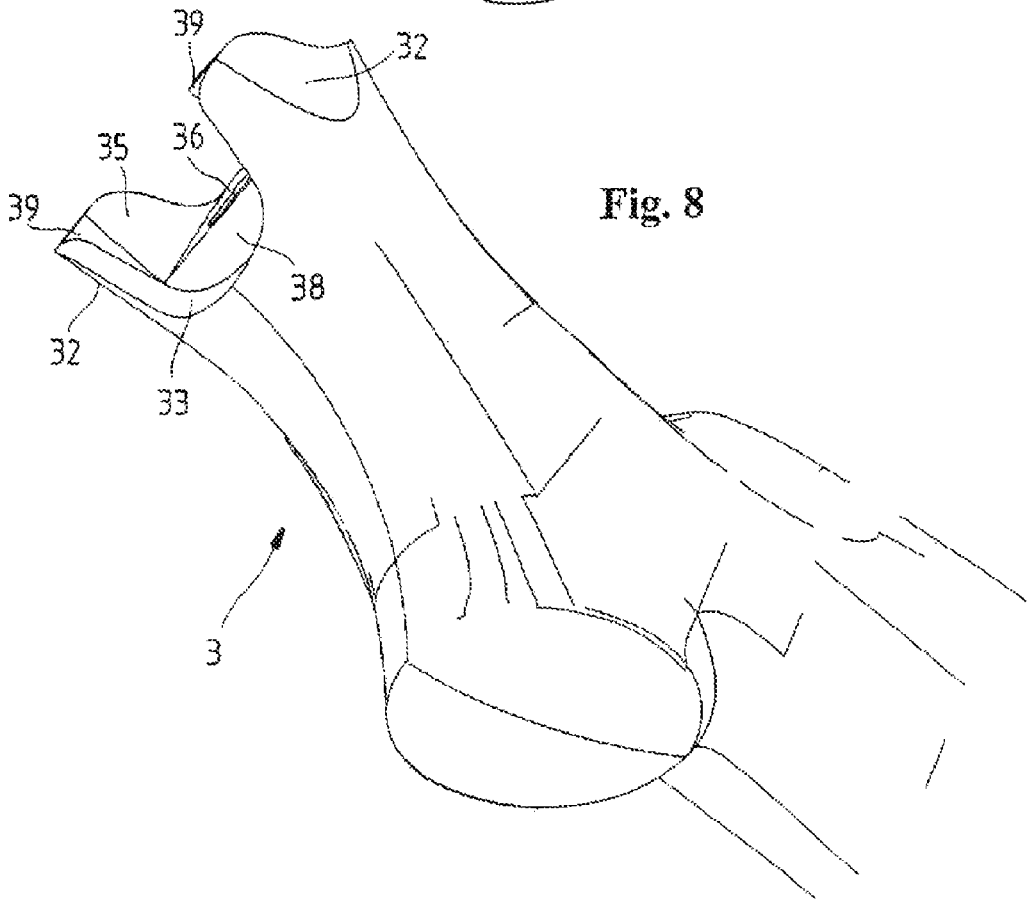
Fig. 8

STOCKS AND CASING FOR A RIFLE

CROSS REFERENCE TO RELATED APPLICATION

This application claims priority under 35 U.S.C. §119 to German Patent Application No. 10 2007 014 899.4 filed Mar. 26, 2007, the entire contents of which are incorporated herein by reference.

FIELD OF THE INVENTION

The invention relates to a stock of a repeating rifle, a system casing of a repeating rifle for such a stock, and a repeating rifle with such a system casing and stock.

BACKGROUND OF THE INVENTION

Stocks of hand firearms are shaped differently according to the type of weapon. They can be made from one piece or from several sub-pieces. For drop-barrel guns and semiautomatic weapons, the stock is usually divided into a front stock and a rear stock. In a few repeating rifles, the mounting also consists of a front stock and rear stock, which are fixed to a system casing. Many times this produces the problem that the connection regions of the stock parts must be produced in a relatively complex and expensive way for connecting to the system casing, in order to guarantee a clean stock connection.

SUMMARY OF THE INVENTION

The task of the invention is to create a stock of a repeating rifle, a system casing of a repeating rifle for such a stock, and a repeating rifle with such a system casing and stock, which allow an improved stock connection.

This task is achieved by a repeating rifle, by a stock of a repeating rifle, and a system casing of a repeating rifle with the features of recited in the independent claims. Useful refinements and advantageous embodiments of the invention are the subject matter of the subordinate claims.

For the stock according to the invention, a centered and precisely fitting connection to a system casing is achieved through the inward tapering recess on the bottom side of the connection region. The bottom contact surface allows a good support of the stock and can prevent an undesired downward displacement of the stock attached to the system casing. The stock can be mounted easily and with a perfect fit and also features good fitting both in the lateral direction and also upward and downward without high axial triggering forces. Through the special construction of the connection region, a smaller loading appears in the stock in the transverse direction of the fiber, and an especially stable connection secured against displacement between the stock and the system casing is enabled.

The system casing is tailored to the construction of the stock according to the invention and features a front closing part tapering forward like a wedge for the front stock and a rear closing part tapering backward like a wedge for the rear stock. Upper support surfaces for contacting the lower contact surfaces of the stock are provided on the system casing.

It has proven especially useful if the front closing parts on the system casing and the associated recesses on the front stock feature a tapering angle of 8.2° and the rear closing parts feature a tapering angle of 26.84° with the associated recesses on the rear stock. In this way, good centering is achieved without seizing.

The closing parts on the system casing and the associated recesses on the stock are preferably rounded at their corners. In this way, a concentration of stresses is avoided.

The connection region of the stock preferably has S-shaped curved end connection faces and the system casing has matching, correspondingly curved lateral contact faces.

The inward tapering recess of the stock is preferably arranged underneath two side cheeks of the connection region. On the insides of the side cheeks there are side faces spaced apart from and parallel to each other for contacting lateral guide faces of the system casing. In this way, good lateral stock fitting is achieved.

BRIEF DESCRIPTION OF THE DRAWINGS

Additional characteristics and advantages of the invention emerge from the following description of a preferred embodiment with reference to the drawing. Shown are.

DETAILED DESCRIPTION OF THE INVENTION

Figure 1:
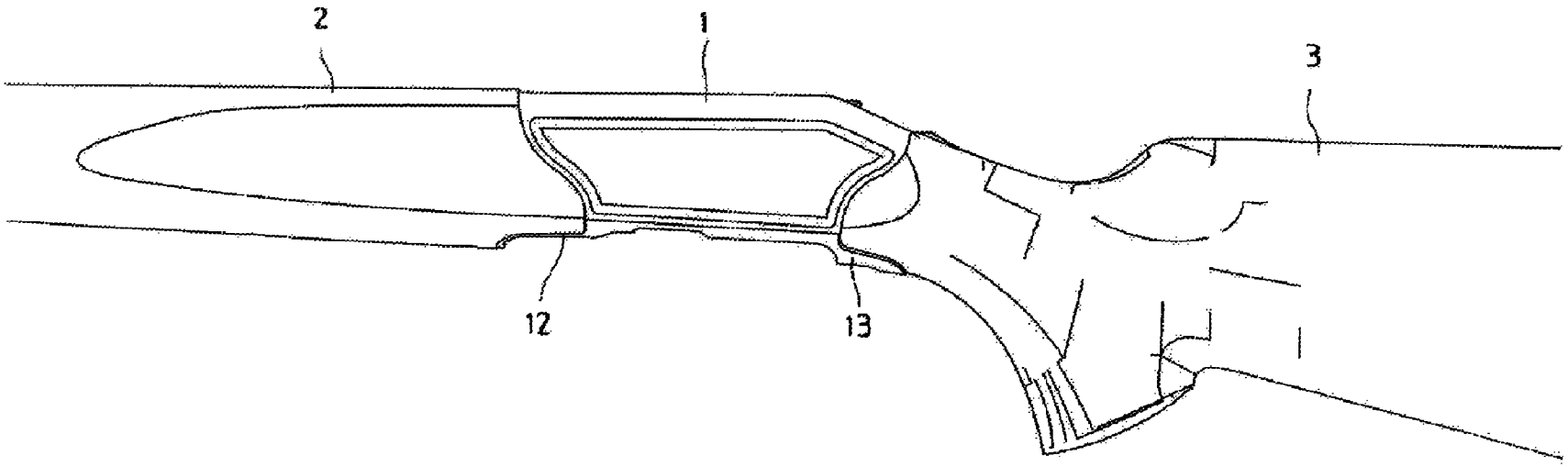
FIG. 1, a system casing with the front and rear stocks of a repeating rifle in a side view, FIG. 2, the system casing of the repeating rifle shown in FIG. 1 in a perspective view, FIG. 3, the system casing from FIG. 1 in a side view, FIG. 4, the system casing from FIG. 1 in a bottom view, FIG. 5, the front stock of the repeating rifle shown in FIG. 1 in a first perspective view, FIG. 6, the front stock of the repeating rifle shown in FIG. 1 in a second perspective view, FIG. 7, a part of the rear stock of the repeating rifle shown in FIG. 1 in a perspective view from the front, and FIG. 8, a part of the rear stock of the repeating rifle shown in FIG. 1 in a perspective view from below.

FIG. 1 schematically shows a part of a repeating rifle with an action housing or system casing 1, a front stock 2, and a rear stock 3 attached to the system casing 1. A not-shown triggering device with a trigger and integrated plug-in magazine can be attached to the bottom side of the system casing 1 in a detachable way.

Figure 2:
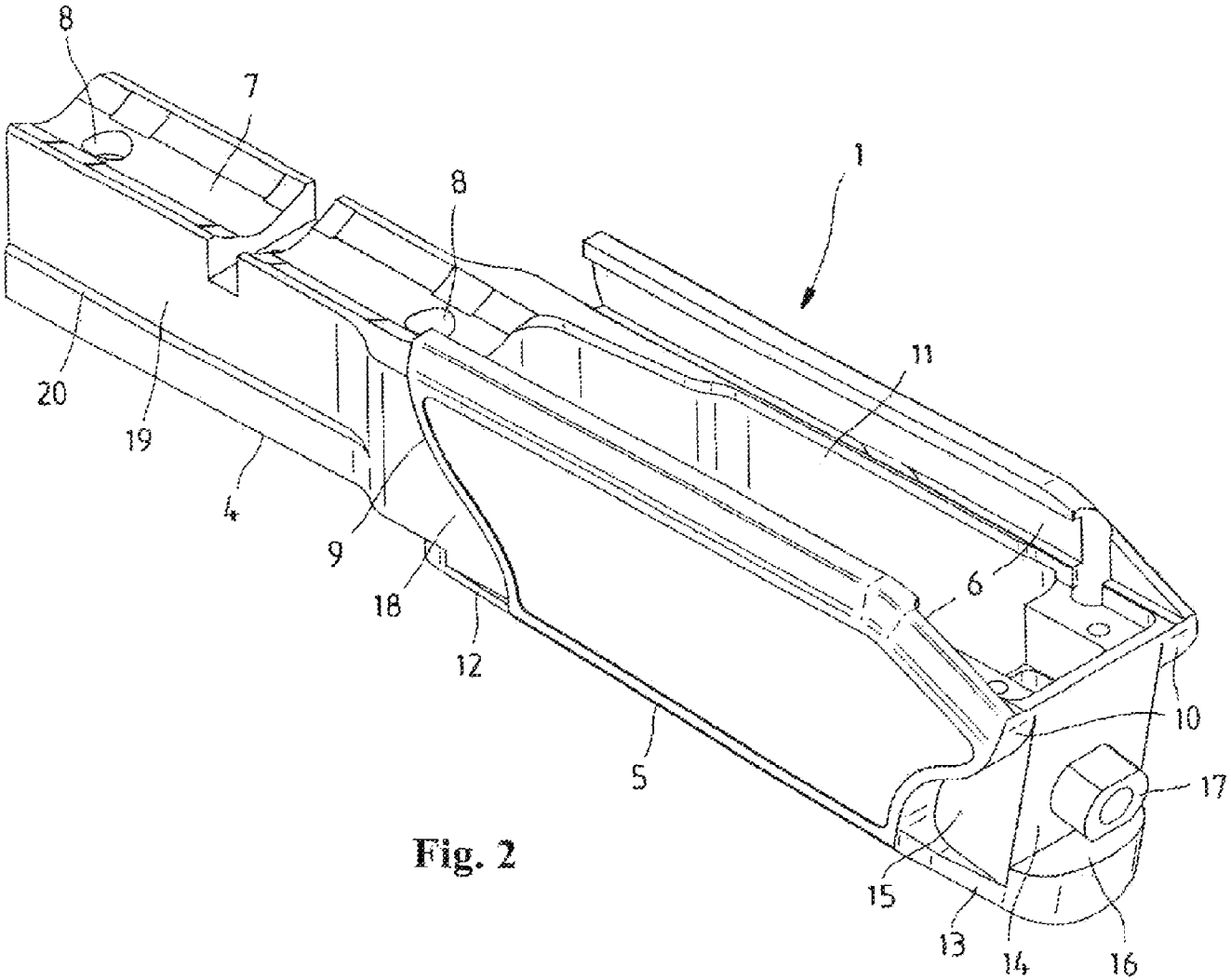
Figure 3:
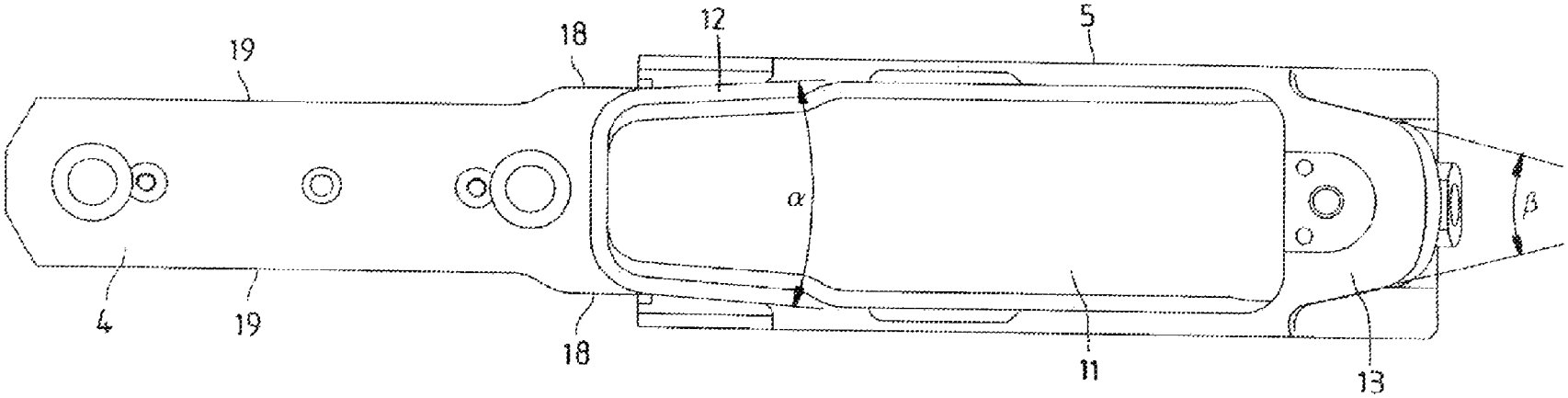
Figure 4:
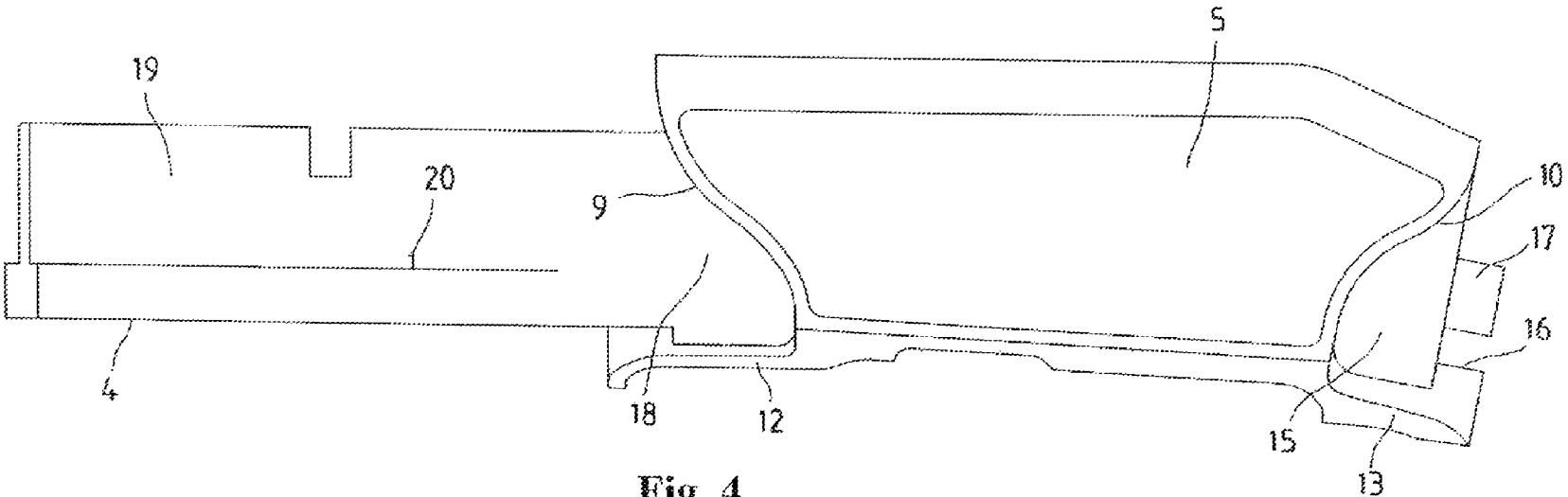

The system casing 1 shown in different views in FIGS. 2-4 contains, according to FIG. 2, a front contact region 4 and a rear guide region 5 with upper guide grooves 6, in which an action, not shown here, is guided in a displaceable way with a locking chamber in a known way. The front contact region 4 contains an upper contact surface 7 for the rear part of a barrel, not shown, which is attached to the system casing 1 by means of boreholes 8. On the rear guide region 5 of the system casing 1, on the two outer sides there are front and rear S shaped curved contact faces 9 and 10 for corresponding connection surfaces of the front or rear stock. The system casing 1 contains a magazine stock 11, in which a magazine can be inserted from below.

As emerges especially from FIGS. 3 and 4, the system casing 1 has, on its bottom side underneath the contact faces 9 and 10, a front closing part 12 tapering forward like a wedge and a rear closing part 13 tapering backward like a wedge. The tapering angle $\alpha$ of the front closing part 12 tapering forward equals 8.2°, while the rear closing part 13 tapering backward like a wedge has a tapering angle $\beta$ of 26.84°. Through the wedge-shaped closing parts 12 and 13, good centering of the front and rear stock is achieved, without the stocks widening or seizing during the attachment to the system casing 1. The two closing parts 12 and 13 are rounded at their ends.

The system casing 1 contains on its rear end a step-shaped projection 14 with parallel lateral guide surfaces 15 and an upper support surface 16. On the projection 14, a peg 17 with a threaded borehole for attaching the rear stock 3 is formed above the support surface 16. The front contact region 4 of the system casing 1 has a wider part adjacent to the guide region with parallel, lateral guide surfaces 18 and a narrow front part with lateral guide surfaces 19, as well as upper support surfaces 20 on both sides. The narrow front part of the contact region 4 has a T profile standing on the head, with the lateral guide surfaces 19 being located on the narrow upper part and the perpendicular, upper support surfaces 20 being located at the junction with the wider, lower part. The upper support surfaces 16 and 20 represent abutments that respectively prevent downward displacement of the front and rear stocks 2 and 3 attached to the system casing 1.

Figure 5:
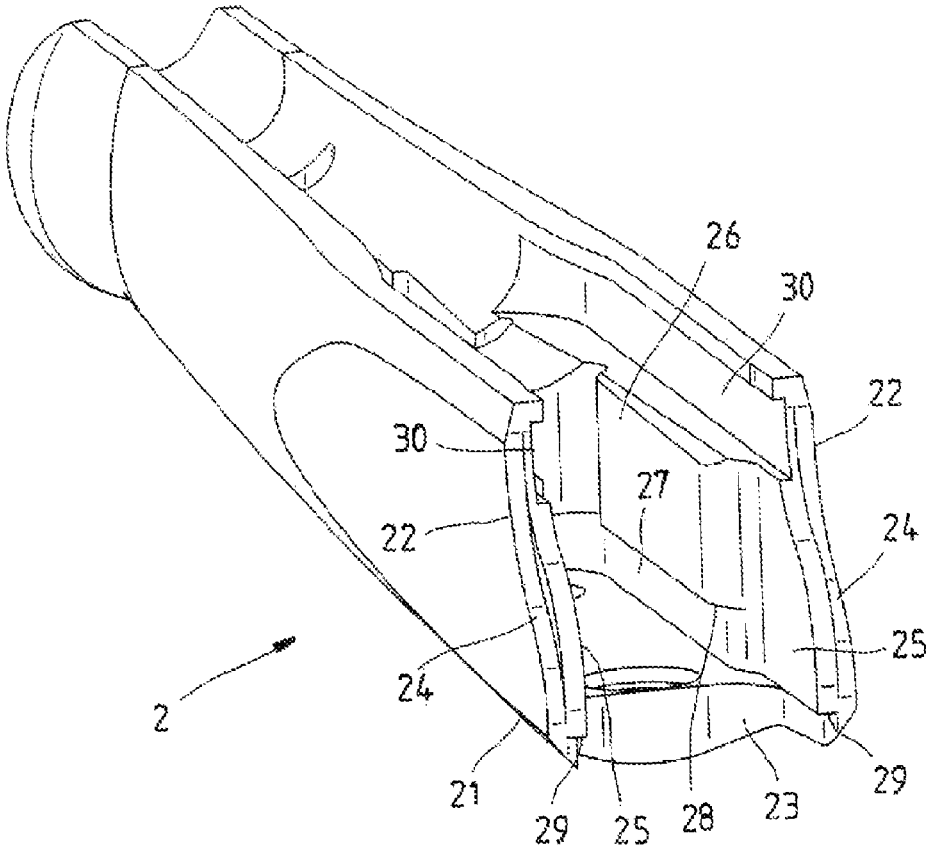
Figure 6:
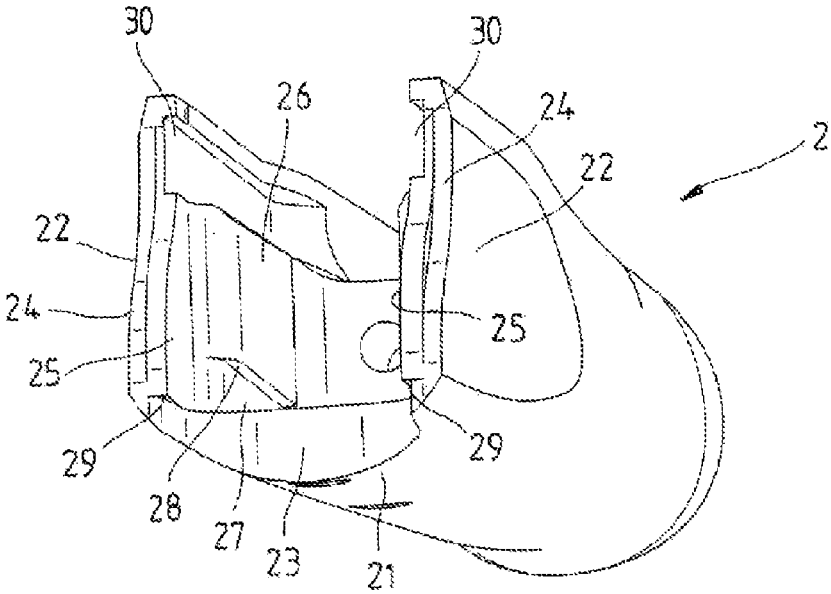

The front stock 2 shown in FIGS. 5 and 6 contains a rear connection region 21 with two parallel side cheeks 22 and a lower recess 23 tapering inward like a wedge, which is adapted to the shape of the front closing part 12 on the system casing 1. Corresponding to the front closing part 12 on the system casing 1, the recess 23 tapering like a wedge also has a tapering angle of 8.2□ on the bottom side of the front stock 2. The side cheeks 22 have S-shaped curved end connection surfaces 24 for contacting the corresponding contact surfaces 9 of the system casing 1. On the inside of the two side cheeks 22 there are side faces 25 and 26 spaced apart from and parallel to each other for contacting the lateral guide surfaces 18 and 19 of the system casing. The side surfaces 25 spaced far apart from each other are designed for contacting the lateral guide surfaces 18 of the wide part and the side surfaces 26 lying closer to each other are designed for contacting the lateral guide surfaces 19 of the narrow part on the front contact region 4 of the system casing 1.

Through a T-shaped groove 27 running in the connection part 21 in the longitudinal direction of the front stock 2, on the inside of the side cheeks 22 underneath the side surfaces 26, a lower contact surface 28 is formed for supporting the front stock 2 on the upper support surfaces 20 of the system casing 1. By contacting the lower contact surfaces 28 on the upper support surfaces 20 of the system casing 1, a downward displacement of the front stock 2 is prevented. The dimensions of the T-shaped groove 27 are adapted to the T-profile of the front part of the contact region 4 of the system casing 1. At the junction of the side surfaces 25 with the recess 23, small triangular lower contact surfaces 29 are provided, as can be seen in FIG. 6. With these small contact surfaces 29, the front stock 2 lies on the front closing part 12. In the upper part of the rear connection region 21 there are guide grooves 30, which lie opposite the inside of the side cheeks 22 and which connect to the guide grooves 6 of the system casing 1 for guiding the action.

As shown in FIGS. 7 and 8, for connecting to the system casing 1, the rear stock 3 contains a front connection region 31 likewise with two parallel side cheeks 32 and a lower recess 33, which tapers inward like a wedge and which is adapted to the shape of the rear connection part 13 on the lower end of the system casing. Corresponding to the rear closing part 13 on the system casing 1, the recess 33 tapering like a wedge has a tapering angle of 26.84° on the bottom side of the rear stock 3. Also on the rear stock 3, the two side cheeks 32 each have S shaped curved end connection surfaces 34 that come into contact with correspondingly shaped contact surfaces 10 of the system casing when the rear stock 3 is mounted. On the inside of the two side cheeks 32 there are side surfaces 35 spaced apart from and parallel to each other for contacting the lateral guide surfaces 15 on the projection 16 of the system casing 1. Between the two side cheeks 32 there is a rear surface 36 with an opening 37 for holding a threaded rod, and a perpendicular lower contact surface 38 that contacts the upper support surface 16 of the system casing 1. Through the support of the lower contact surface 38 on the upper support surface 16 of the system casing 1, a downward displacement of the rear stock is prevented. As on the front stock 2, on the junction of the side surfaces 35 with the recess 33, small triangular support surfaces 39 are provided, with which the rear stock 3 contacts the rear closing part 13, as can be seen in FIG. 8.

The invention claimed is:

1. A firearm stock engageable with a system stock having two ends and two longitudinally extending guide surfaces, the stock comprising:

a first stock portion including a connection region at an end of said first stock portion, the connection region operative to connect the first stock portion to the system casing, said connection region containing two side cheeks having inner sides, each side cheek further defining end facing curved connection surfaces operative to matingly engage said two end facing curved connection surfaces of said system casing, a recess tapering inward and positioned underneath said two side cheeks, said recess operative to matably engage said end facing tapered side surface of the system casing, and two longitudinally extending guide surfaces spaced apart and parallel to each other, positioned on said inner sides of said two side cheeks, and operative to matably engage the longitudinally extending guide surfaces of the system casing; and two triangular lower contact surfaces each positioned proximate an inner side of a side cheek.

2. The firearm stock of claim 1, wherein the end facing curved connection surface of said first stock portion is curved in an S-shape.

3. The firearm stock of claim 1, wherein the recess tapering inward forms a corner, and where said corner is rounded.

4. The firearm stock of claim 1, wherein the first stock portion is constructed as a front stock, and wherein the recess tapering inward has a tapering angle of 8.2°.

5. The firearm stock of claim 1, wherein the first stock portion is constructed as a rear stock, and wherein the recess tapering inward has a tapering angle of 26.84°.

6. The firearm stock of claim 1, further including a second stock portion at a second end of said stock, said second stock portion including a curved connection surface, and wherein the system casing has a second end including an end facing curved connection, and wherein said second stock portion curved connection surface is operative to matably engage the end facing curved connection at the second end of the system casing.

7. The firearm stock of claim 1, wherein the system casing has, on its rear end, a step-like projection on which an upper support surface is formed, and wherein said first stock portion has a lower contact surface operative to engage the step-like projection of the system casing.

8. The firearm stock of claim 1, wherein the system casing includes a rear guide region having guide grooves operative to guide a displaceable action.

9. A firearm stock engageable with a system casing having an end facing curved connection surface and a longitudinal guide surface, the stock comprising:

a first stock portion including a connection region at an end of the first stock portion, the connection region operative to connect the first stock portion to the system casing, the connection region containing an end facing curved connection surface operative to matably engage an end facing curved connection surface of the system casing, an end facing recess tapering inward and operative to matably engage the system casing, and a longitudinally extending guide surface operative to matably engage the guide surface of the system casing, wherein the system casing has a tapered end surface, and wherein said first stock portion has a first tapered surface at an end matable with the tapered surface of the system casing.

10. The firearm stock of claim 9, wherein said first stock portion further includes a side cheek associated with said end facing curved connection surface of said first stock portion, and wherein said recess tapering inward is positioned underneath said side cheek.

11. The firearm stock of claim 9, wherein the system casing has two longitudinally extending guide surfaces, and wherein said first stock portion includes two end facing curved connection surfaces and further includes two side cheeks each forming one of said two end facing curved connection surfaces of said first stock portion, said first stock portion further having two longitudinally extending guide surfaces, and wherein said two longitudinally extending guide surfaces of the first stock portion are spaced apart from and parallel to each other, and are positioned on inner sides of the two side cheeks, and are operative to matably engage two longitudinally extending guide surfaces of the system casing.

12. The firearm stock of claim 9, wherein said longitudinally extending guide surface of said first stock portion is formed by a groove in the connection region.

13. The firearm stock of claim 12, wherein said first stock portion has two longitudinally extending guide surfaces, each formed by a groove, said grooves lying opposite each other, and wherein said grooves are provided in an upper part of the connection region.

14. The firearm stock of claim 9, wherein the first tapered surface has a tapering angle $\alpha$ of 8.2°.

15. A firearm, comprising:

a system casing having a first end including an end facing curved connection surface, two opposing end facing tapered side surfaces, and a longitudinally extending guide surface; and a first stock portion including a connection region at an end of said first stock portion, said connection region operative to connect said first stock portion to said system casing, said connection region containing an end facing curved connection surface operative to matingly engage said end facing curved connection surface of said system casing, a recess tapering inward operative to matably engage said end facing tapered side surface of said system casing, and an opposed longitudinally extending guide surface operative to matably engage said longitudinally extending guide surface of said system casing, wherein said system casing has a second end including an end facing curved connection surface, two opposing end facing tapered side surfaces, and a longitudinally extending guide surface, and wherein said firearm further includes a second stock portion including a second connection region at an end of said second stock portion, said second connection region operative to connect said second stock portion to said second end of said system casing, said second connection region containing an end facing curved connection surface operative to matingly engage said end facing curved connection surface of said second end of said system casing, a recess tapering inward operative to matably engage said end facing tapered side surfaces of said second end of said system casing, and an opposed longitudinally extending guide surface operative to matably engage said longitudinally extending guide surface of said second end of said system casing.

16. The firearm of claim 15, wherein said first end of said system case includes two opposing end facing tapered side surfaces, and two longitudinally extending guide surfaces, and wherein said first stock portion includes two recesses tapering inward operative to matably engage said end facing tapered side surfaces of said system casing, and two opposed longitudinally extending guide surfaces operative to matably engage said longitudinally extending guide surfaces of said system casing.

17. The firearm of claim 15, wherein said first end of said system case includes two end facing curved connection surfaces, and said first stock portion includes two end facing curved connection surfaces operative to matably engage said end facing curved connection surfaces of said first end of said system case.

* * * * *